US005433755A

United States Patent [19]

Mulard et al.

[11] Patent Number: 5,433,755

[45] Date of Patent: Jul. 18, 1995

[54] ADDITIVE FORMULATION FOR FUELS INCORPORATING ESTER FUNCTION PRODUCTS AND A DETERGENT-DISPERSANT

[75] Inventors: Philippe Mulard, Saint Pierre de Chandieu; Yvan Labruyere, Lyons; Alain Forestiere, Vernaison; Roger Bregent, Oinville sur Montcient, all of France

[73] Assignees: Institut Francais du Petrole, Rueil-Malmaison; Elf France, Paris, both of France

[21] Appl. No.: 936,410

[22] Filed: Aug. 31, 1992

[30] Foreign Application Priority Data

Aug. 30, 1991 [FR] France ..... 91 10851

[51] Int. Cl.[6] ..... C10L 1/22

[52] U.S. Cl. ..... 44/330; 44/331; 44/386; 44/399; 44/443; 44/412

[58] Field of Search ..... 44/330, 331, 399, 386, 44/412, 443

[56] References Cited

U.S. PATENT DOCUMENTS

| | | | |
|---|---|---|---|
| 2,922,706 | 1/1960 | Durr, Jr. et al. | 44/58 |
| 2,937,933 | 5/1960 | Heisler et al. | 44/70 |
| 2,993,773 | 7/1961 | Stromberg et al. | 52/0.5 |
| 3,871,837 | 3/1975 | Bedague et al. | 44/58 |
| 4,129,508 | 12/1978 | Friihauf | 252/33 |
| 4,292,046 | 9/1981 | Piotrowski | 44/331 |
| 4,375,974 | 3/1983 | Maldonado et al. | 44/331 |
| 4,968,321 | 11/1990 | Sung et al. | 44/337 |
| 4,976,746 | 12/1990 | Denis et al. | 44/331 |
| 5,004,478 | 4/1991 | Vogel et al. | 44/398 |
| 5,049,290 | 9/1991 | Emert et al. | 252/32.7 E |
| 5,053,056 | 10/1991 | Montagne et al. | 44/330 |

FOREIGN PATENT DOCUMENTS

| | | |
|---|---|---|
| 0349369 | 3/1990 | European Pat. Off. . |
| 1465700 | 2/1977 | United Kingdom . |

*Primary Examiner*—Margaret Medley

*Attorney, Agent, or Firm*—Millen, White, Zelano & Branigan

[57] ABSTRACT

Additive formulation for engine fuels incorporating at least one constituent (A) and at least one constituent (B), constituent(A) consisting of at least one composition incorporating products resulting from the reaction of at least one dicarboxylic compound(D), whose carboxylic functions are separated by at the most eight carbon atoms, with at least one polyoxyalkylene glycol or glycol mono-ether (E) of general formula (I):

$$R^1—O—(R^2—O)_n—H,$$

in which $R^1$ represents a hydrocarbon group having 1 to 30 carbon atoms, $R^2$ represents a divalent hydrocarbon group having 2 to 6 carbon atoms and n is a number from 1 to 60; and constituent (B) consisting of at least one detergent-dispersant product. This formulation preferably also comprises a constituent (C) chosen from within the group formed by mineral or synthetic lubricating oils and polyglycols soluble in the fuel. The formulation can be used as multifunctional additives for fuels employed in internal combustion engines and in particular those used in controlled ignition engines.

20 Claims, No Drawings

ADDITIVE FORMULATION FOR FUELS INCORPORATING ESTER FUNCTION PRODUCTS AND A DETERGENT-DISPERSANT

The present invention relates to additive formulations, particularly for fuels, incorporating ester function products and a detergent-dispersant. These formulations can be used as multifunctional additives for fuels and in particular for fuels used in controlled ignition engines.

The use of conventional fuels very frequently leads to the fouling of different parts of the engine as a result of incomplete vaporization and combustion of the fuel in the admission or induction system and in the combustion chambers and also relatively frequently as a result of the presence of lubricant traces° Particularly in the case of controlled ignition engines, the formation and accumulation of deposits in the combustion chambers disturb the normal operating conditions of the engine. These deposits significantly modify the thermal exchanges between the combustion chambers and the engine cooling system by forming a layer having an insulating character. This causes an increase in the temperature in the chambers and the admitted gaseous mixture is exposed thereto. This aids the auto-ignition of these gases, which leads to the well-known engine pinking phenomenon.

Moreover, the accumulation of these deposits in combustion chambers can lead to a reduction of the volume of the combustion area, which then leads to an increase in the compression ratio of the engine, which also favors the occurrence of pinking. Moreover, the deposits forming in different parts of the engine in contact with the fuel can partly absorb some of the fuel, thus contributing to a modification of the fuel-combustion supporter mixture with a fuel depletion phase during absorption and an enrichment phase in the case of a desorption of fuel. The modification of the richness of the fuel-air mixture no longer enables the engine to operate under optimum conditions.

In order to prevent fouling it is possible to carry out a very onerous, periodic cleaning of the members involved and in particular the valves. The accumulation of deposits in the engines and in particular on induction valves can also be reduced by the use of fuels containing certain additives, e.g., those of the detergent type optionally combined, e.g., with anticorrosion or antideposit additives for the combustion chamber.

The additives, which are well known commercially, e.g., those of the polyisobutylene-amine type are conventionally associated with a mineral or synthetic oil and are liable to cause increased fouling of the combustion chambers and therefore an octane requirement increase or ORI of the engine with a greater sensitivity to the pinking phenomenon.

Among the additives described in the prior art, reference can be made to condensation products of polyalkenyl succinic anhydrides on polyamines, such as, e.g., tetraethylene pentamine, more particularly described in U.S. Pat. No. 3,172,892. These additives give good results with respect to the anticorrosion properties, but are not effective as valve detergents. Reference can also be made to condensation products of polyalkenyl succinic anhydrides on hydroxyimidazolines and in particular on 1-(2-hydroxyethyl)-imidazolines substituted in the two-position by an alkyl or alkenyl group, such as those described in European patent application EP-A-74724. The products described in the latter are good additives for engine fuels and have a good anticorrosion action, but are not very effective from the standpoint of carburettor detergency.

The fouling of combustion chambers occurs progressively during the operation of the engine. The latter is characterized by its octane requirement, which corresponds to the minimum octane number level of the fuel necessary for the engine in order that it can function without pinking. When the octane requirement value of the engine exceeds, particularly due to the fouling of the combustion chambers, the octane number of the fuel used for supplying the engine, the pinking phenomenon occurs. The octane requirement increase or ORI of the engine is well known to the Expert.

In order to limit the appearance of pinking and its prejudicial consequences for the engine such as increased fatigue and wear of its vital parts, it is possible to prevent an excessive octane requirement of the engine by using, provided that it is available and at high economic cost, a fuel having an octane number higher than that previously used. It is also possible to periodically clean the combustion chambers in order to eliminate the deposits formed and reduce the engine octane requirement. However, this operation is long and very costly.

Numerous patent documents describe additives usable, particularly in engine fuels. Belgian Patent 811,678 describes fuel compositions containing a lubricant in ester form and in particular an ester of diacids and alcohol or diols. Among the diols referred to are polyoxyalkylene glycols. The preferred diacids usable according to the latter application include adipic, azelaic and sebacic acid. U.S. Pat. No. 3,429,817 describes lubricating compositions containing synthetic esters resulting from the reaction of 2 moles of a glycol having 2 to 5 carbon atoms and a diacid, whose carboxylic groups are separated from one another by at least 9 carbon atoms. U.S. Pat. No. 3,836,470 describes lubricating compositions and fuel compositions containing a dispersing additive more particularly resulting from the reaction of a succinic acid, having a hydrocarbon side chain and at least 30 carbon atoms in its molecule, on at least one polyoxyalkylene glycol or a polyoxyalkylene glycol ether. Reference can also be made to compositions like those, e.g., described in European patent application EP-A-327,097, which have good anti-ORI properties and good detergent properties at the induction valves, but relatively limited detergent properties at the single-point injector. Moreover, these compositions are not described as having good anticorrosion properties.

Surprisingly formulations have now been discovered, such as those described hereinafter, which can be used as multifunctional additives for engine fuels and in particular for those used in controlled ignition engines. The formulation of the present invention have excellent detergent properties at the induction valves and carburettor and have very good anticorrosion properties.

These formulations used as multifunctional additives in engine fuels and more particularly in fuels used in controlled ignition engines inhibit or significantly reduce the formation of deposits on admission or induction valves, as well as the fouling of carburettors or injectors. They also greatly reduce the corrosion of various mechanical parts with which the fuel comes into contact.

The present invention relates to an additive formulation more particularly usable as a multifunctional additive for fuels, which comprises at least one constituent (A) and at least one constituent (B), said constituent (A) consisting of at least one composition incorporating the products resulting from the reaction of at least one dicarboxylic compound (D), whose carboxylic functions are separated by at the most 6 carbon atoms and preferably at the most 4 carbon atoms, on at least one polyoxyalkylene glycol or glycol monoether (E) of general formula (I):

$$\text{(I)}\ R^1—O—(R^2—O)_n—H$$

in which $R^1$ represents a hydrocarbon group having 1 to 30 carbon atoms, preferably an alkyl, alkaryl or aralkyl radical having 1 to 25 carbon atoms, $R^2$ represents a divalent hydrocarbon group having 2 to 6 carbon atoms and n is a number from 1 to 60; and the constituent (B) consisting of at least one detergent-dispersant product.

The formulations according to the present invention are more particularly usable as additives in fuels used in controlled ignition engines, in which they in particular make it possible to limit the octane requirement increase (ORI) of said engines and therefore limit, delay or even avoid the appearance of the pinking phenomenon. These formulations also have an anticorrosion action, which can be observed both with the fuels used in controlled ignition engines and in those used in auto-ignition engines (diesel engines).

As examples of fuels which can contain at least one additive formulation according to the invention, reference can be made to petrols such as those defined by ASTM Standard D-439, as well as diesel fuels or gas oils as defined in ASTM Standard D-975. These fuels can also contain other additives, such as, e.g., particularly in the case of fuels used for controlled ignition engines, antiknock additives such as compounds of lead (e.g. tetraethyl lead), ethers such as methyl tert. butyl ether or methyl tert. amyl ether or a mixture of methanol and tert. butyl alcohol and antifreeze additives. It is also possible to add the formulations according to the present invention to a non-hydrocarbon fuel, such as, e.g., an alcohol or a mixture of alcohols.

The constituent (A) according to the present invention can result from the reaction of at least one compound (D) with at least one compound (E) under conventional conditions in connection with the formulation of products incorporating ester functions. The preferred constituent (A) according to the invention is normally obtained by carrying out the reaction at a temperature of approximately 100° C. to approximately 210° C. and more frequently from approximately 120° C. to approximately 200° C., with a molar ratio of compound (E) to compound (D) of approximately 1.5:1 to approximately 5:1 and for a time adequate to ensure that the products obtained have a corrected acid number from approximately 2000 to approximately 40,000, preferably approximately 3000 to approximately 30,000 and most frequently approximately 4000 to approximately 25,000.

The corrected acid number is a number calculated on the basis of the acid number evaluated in accordance with AFNOR Standard T-60-112 and the average molecular weight of the considered polyoxyalkylene glycol monoether, in the following way: corrected acid number (IAc)=acid number x molecular weight of polyoxyalkylene glycol monoether.

Within the scope of the present invention, the compounds (E) used in preferred manner are those in which $R^2$ represents an alkylene group having 2 to 5 carbon atoms and of general formula (II):

$$\text{(II)}\ —CH_2—CR^3H—$$

which $R^3$ represents a hydrogen atom, a methyl group, an ethyl group or a propyl group. Among other preferred compounds are those in which $R^1$ represents a straight or branched alkyl group. Among the compounds (E), most frequently use is made of those in which n is a number from 5 to 50.

As specific examples of polyoxyalkylene glycols, reference can be made to alkyl monoethers of glycol or polyoxyalkylene glycols such as polypropylene glycol alkyl monoethers, polyethylene glycol alkyl monoethers and ethylene glycol and polypropylene glycol alkyl monoethers. The alkyl group of these products usually contains at least 3 carbon atoms and is most frequently straight. For example of an alkyl group, reference can be made to n-pentyl and n-heptyl groups. These oxyalkyl products are commercially available from SHELL under the generic name OXYLUBE or from ICI. These compounds normally have a molecular weight of approximately 500 to approximately 2500 and most frequently from approximately 600 to approximately 2000. As examples of these compounds reference can be made to those sold by ICI and which have a block structure of type $R^5$—O— +q (propylene oxide)+p (ethylene oxide), in which $R^5$ represents an alkyl group having 1 to 20 carbon atoms, q is the propylene oxide unit number and p the number of ethylene oxide units.

Within the scope of the present invention the compounds (D) used are normally aliphatic, alicyclic or aromatic dicarboxylic compounds. These compounds can be saturated or unsaturated. The compounds (D) used in preferred manner are chosen within the group formed by oxalic (ethane-dioic), malonic (propanedioic), succinic (butane-dioic), glutaric (pentane-dioic), adipic (hexane-dioic), pimelic (heptane-dioic), suberic (octane-dioic), fumaric (trans-butene-dioic), maleic (cis-butene-dioic), glutaconic (2-pentene-dioic), muconic (2,4-hexadiene-dioic), citraconic (cis-methyl butene-dioic), mesaconic (trans-methyl butenedioic), itaconic (methylene butane-dioic) and phthalic acids or one of their derivatives and most frequently from within the group formed by oxalic, maleic and phthalic acids or one of their derivatives. Frequently use is made of an acid anhydride and in particular phthalic anhydride or maleic anhydride.

The constituent (B) according to the present invention is normally chosen from within the group formed by polyolefins, preferably polyisobutylenes, polyisobutylene-amines, mixtures of such compound types and the products which are more particularly described in European patent application EP-A-349,369 in the name of the present assignee, as well as those described in U.S. Pat. No. 4,375,974. The products described in EP-A-349,369 result from the reaction in a first stage of at least one succinic derivative chosen from within the group formed by alkenyl succinic anhydrides and acids and polyalkenyl succinic anhydrides and acids with at least one 1-(2-hydroxyethyl)-imidazoline substituted in the 2-position by a straight or branched alkyl or alkenyl radical, having 1 to 25 carbon atoms, the imidazoline/-succinic derivative molar ratio being 0.1:1 to 0.9:1, preferably 0.2:1 to 0.8:1 and most frequently 0.3:1 to 0.7:1, said stage being performed under conditions such that formation and elimination takes place with at least 0.15 mole of water per mole of imidazoline used; and in a second stage of the reaction of the product: from the first stage on at least one polyamine complying with one of the following general formulas:

$$R^3-Z-[(CH)_p(R^4)NH]_m-H \quad \text{(III)}$$

$$R^3-N(R^5)-D-(O-E)_a-(O-F)_b-(O-G)_c-NH_2 \quad \text{(IV)}$$

in which $R^3$ represents a hydrogen atom or a hydrocarbon group having 1 to 60 carbon atoms, Z is chosen from among —O— and —$NR^5$— groups, in which $R^5$ represents a hydrogen atom or a hydrocarbon group having 1 to 60 carbon atoms and in which $R^3$ and $R^5$ can form together with the nitrogen atom to which they are linked a heterocycle, each of the $R^4$ independently representing a hydrogen atom or a hydrocarbon group having 1 to 4 carbon atoms, p is an integer from 2 to 6, m is an integer from 1 to 10 when Z equals —$NR^5$— and an integer from 2 to 10 when Z is —O—, D,E,F and G, which are the same or different, each representing a divalent hydrocarbon group having 2 to 6 carbon atoms, a is an integer from 1 to 60, b and c, which can be the same or different, are in each case zero or an integer from 1 to 50 and the sum a+b+c is an integer from 1 to 60, the reacted polyamine quantity being at least 0.1 mole per mole of succinic derivative introduced into the first stage. The total quantity of substituted imidazoline and polyamine is preferably 0.8 to 1.2 mole per mole of succinic derivative.

The succinic anhydride or acid used within the scope of the present invention for the preparation of the constituent (B) normally has a number average molecular weight of approximately 200 to 3000, preferably 500 to 2000 and most frequently 700 to 1500. These succinic derivatives have been widely described in the prior art. They are, e.g., obtained by the action of at least one alpha-olefin on a hydrocarbon chlorinated on maleic acid or anhydride. The alpha-olefin or chlorinated hydrocarbon used in this synthesis can be straight or branched and normally have 10 to 150 carbon atoms, preferably 15 to 80 carbon atoms and most frequently 20 to 75 carbon atoms in their molecule. This olefin can also be an oligomer, e.g., a dimer, a trimer or a tetramer, or a polymer of a lower olefin having, e.g., 2 to 10 carbon atoms, such as ethylene, propylene, 1-n-butene, isobutene, 1-n-hexene, 1-n-octene, 2-methyl-1-heptene or 2-methyl-5-propyl-1-hexene. It is possible to use mixtures of olefins or mixtures of chlorinated hydrocarbons.

As examples of succinic anhydrides used for preparing the constituent (B), reference can be made to n-octadecenyl succinic anhydride, dodecenyl succinic anhydride and polyisobutenyl succinic anhydrides, often called PIBSA, having a number average molecular weight as defined hereinbefore. 1-(2-hydroxyethyl-)imidazoline substituted in the 2-position by an alkyl or alkenyl radical having 1 to 25 carbon atoms are normally commercially available compounds or which can be synthesizing e.g., by reacting at least one organic acid with N-(2-hydroxyethyl)-ethylene diamine. The reaction involves a first amidification stage followed by a cyclization. The organic acids used normally have 2 to 26 carbon atoms and are preferably monocarboxylic aliphatic acids.

Reference can, e.g., be made to acetic, propanoic, butanoic, caproic, capric, lauric, myristic, palmitic, stearic, behenic, cerotic and the following unsaturated fatty acids:

| | |
|---|---|
| $CH_3-CH_2-CH=CH-(-CH_2-)_7-COOH$ | dodecylenic acid |
| $CH_3-(-CH_2-)_5-CH=CH-(-CH_2-)_7-COOH$ | palmitoleic acid |
| $CH_3-(-CH_2-)_7-CH=CH-(-CH_2-)_7-COOH$ | oleic acid |
| $CH_3-(-CH_2-)_5-CHOH-CH_2-CH=CH-(-CH_2-)_7-COOH$ | ricinoleic acid |
| $CH_3-(-CH_2-)_{10}-CH=CH-(-CH_2-)_4-COOH$ | petroselenic acid |
| $CH_3-(-CH_2-)_5-CH=CH-(-CH_2-)_9-COOH$ | vaccenic acid |
| $CH_3-(-CH_2-)_4-CH=CH-CH_2-CH=CH-(-CH_2-)_7-COOH$ | linoleic acid |
| $CH_3-(-CH_2-)_9-CH=CH-(-CH_2-)_7-COOH$ | gadoleic acid |
| $CH_3-(-CH_2-)_9-CH=CH-(-CH_2-)_9-COOH$ | cetoleic acid |
| $CH_3-(-CH_2-)_7-CH=CH-(-CH_2-)_{11}-COOH$ | erucic acid |
| $CH_3-(-CH_2-)_7-CH=CH-(-CH_2-)_{13}-COOH$ | selacholeic acid |

Use is, e.g., made of 1-(2-hydroxyethyl)-2-heptadecenyl imidazoline, e.g., prepared from oleic acid and N-(2-hydroxyethyl)-ethylene diamine. This preparation is, e.g., described in U.S. Pat. No. 2,987,51.5. Reference can also be made, e.g., to 1-(2-hydroxyethyl)-2-methyl imidazoline, e.g., prepared from acetic acid and N-(2-hydroxyethyl)-ethylene diamine. 1-(2-hydroxyethyl)-2-heptadecenyl imidazoline is marketed by CIBA GEIGY under the name "Amine-O" and by PROTEX under the name "Imidazoline-O".

The first stage of the preparation of constituent (B) according to the invention is normally carried out by the progressive addition of the imidazoline derivative to a solution of the succinic derivative in an organic solvent, at ordinary temperature, followed by heating to a temperature normally between 65° and 250° C. and preferably between 80° and 200° C. The organic solvent used in this preparation has a boiling point between 65° and 250° C. and is normally chosen so as to be able to permit the elimination of the water formed during the condensation of the imidazoline on the succinic derivative, preferably in the form of a water-organic solvent azeotrope. Use is normally made of an organic solvent such as e.g. benzene, toluene, xylenes, ethyl benzene or a hydrocarbon fraction, such as e.g. the commercial fraction SOLVESSO 150 (190° to 209° C.) containing 99% by weight of aromatic compounds. It is possible to use mixtures of solvents, e.g. a mixture of xylenes. The duration of the heating after the end of imidazoline addition is normally 0.5 to 7 hours, preferably 1 to 5 hours. This first stage will preferably be continued at the chosen temperature until all the water formed during the reaction has been given off.

The water quantity eliminated during this first stage is normally approximately 0.15 to 0.6 mole and most frequently approximately 0.5 mole per mole of imidazoline used in the reaction. To the product or mixture resulting from the first stage, after optional cooling, is preferably progressively added at least one polypmine, preferably in diluted form in an organic solvent, followed conventionally by heating to a temperature between 65° and 250° C. and preferably between 80° and 200° C. The solvent used in the second stage is preferably the same as that used in the first stage and the temperature is also the same for the two stages. The reactions are normally performed at a temperature corresponding to the reflux temperature. The duration of this heating during the second stage is normally 0.1 to 7 hours and preferably 0.2 to 5 hours. The polyamine quantity used is at least 0.1 mole per mole of succinic anhydride introduced during the first stage and is preferably such that the total quantity of substituted imidazoline and polyamine used in the preparation is 0.8 to 1.2 mole, preferably 0.9 to 1.1 mole per mole of succinic derivative. The substituted imidazoline to polyamine molar ratio is preferably 1:1 to 7:1 and in more preferred manner 1:1 to 3:1. The water quantity eliminated during this second stage is normally such that the total eliminated water quantity during the two successive reactions represents 0.2 to 0.7 mole per mole of succinic derivative.

The polyamines of formula (III) are preferably those in which $R^3$ is a hydrogen atom or a hydrocarbon group having 1 to 30 carbon atoms, Z is preferably a —$NR^5$— group, in which $R^5$ preferably represents a hydrogen atom or a hydrocarbon group having 1 to 30 carbon atoms, each of the $R^4$ independently preferably representing a hydrogen atom or a methyl group, p is an integer from 2 to 4 and when Z is a —$NR^5$— group, m is preferably a integer from 1 to 5.

Among the compounds of the aforementioned formulas (III), it is advantageous to use those in which Z is —$NR^5$—, $R^3$, $R^4$ and $R^5$ each representing a hydrogen atom, p is equal to 2 and m is an integer from 1 to 5, or those in which $R^3$ represents a hydrocarbon group preferably having 5 to 24 carbon atoms, Z represents a —$NR^5$— group, in which $R^5$ is a hydrogen atom, $R^4$ represents a hydrogen atom, p is an integer from 2 to 4, preferably 3, and m is an integer from 1 to 5, preferably 1.

The hydrocarbon groups $R^3$ and $R^5$ are normally straight or branched alkyl or alkenyl groups, aryls, aryl-alkyls (aralkyls), alkyl-aryls (alkaryls) or cycloaliphatics. The groups $R^3$ and $R^5$ are preferably straight or branched alkenyl or alkyl groups. The hydrocarbon group $R^4$ is normally an alkyl group, which is preferably linear and is e.g., methyl, ethyl, n-propyl or n-butyl.

As specific compounds reference can be made to ethylene diamine, propylene diamine, triethylene tetramine, tripropylene tetramine, tetraethylene pentamine, trimethylene diamine, hexamethylene diamine, 2,2,4- and 2,4,4-trimethyl-hexamethylene diamine, di-(trimethylene)-triamine, N-alkyl-1,3-diaminopropane, e.g., N-dodecyl-1,3-diaminopropane, N-tetradecyl-1,3-diaminopropane, N-hexadecyl-1,3-diaminopropane, N-octadecyl-1,3-diaminopropane, N-eicosyl-1,3-diaminopropane and N-docosyl-1,3-diaminopropane. Reference can also be made to N-alkyl dipropylene triamines e.g., N-hexadecyl dipropylene triamine, N-octadecyl dipropylene triamine, N-eicosyl dipropylene triamine and N-docosyl dipropylene triamine. Reference can also be made to N-alkenyl-1,3-diamino, propane and N-alkenyl dipropylene triamines, e.g., N-octadecenyl-1,3-diaminopropane, N-hexadecenyl-1,3-diaminopropane, N-dodecylenyl-1,3-diaminopropane, N-octadecadienyl-1,3-diaminopropane and N-docosenyl-1,3-diaminopropane. Reference can also be made as examples of disubstituted N,N-diamines to N,N-diethyl-1,2-diaminoethane, N,N-diisopropyl-1,2-diaminoethane, N,N-dibutyl-1,2-diaminoethane, N,N-diethyl-1,4-diaminobutane, N,N-dimethyl-1,3-diaminopropane, N,N-diethyl-1,3-diaminopropane, N,N-dioctyl-1,3-diaminopropane, N,N-didecyl-1,3-diaminopropane, N,N-didodecyl-1,3-diaminopropane, N,N-ditetradecyl-1,3-diaminopropane, N,N-dinexadecyl-1,3-diaminopropane, N,N-dioctadecyl-1,3-diaminopropane, N,N-didodecyl dipropylene triamine, N,N-ditetradecyl dipropylene triamine, N,N-dihexadecyl dipropylene triamine, N,N-dioctadecyl dipropylene triamine, N-methyl, N-butyl-1,2-diaminoethane, N-methyl,N-octyl-1,2-diaminoethane, N-ethyl,N-octyl-1,2-diaminoethane, N-methyl,N-decyl-1,2-diaminoethane, N-methyl,N-dodecyl-1,3-diaminopropane, N-methyl,N-hexadecyl-1,3-diaminopropane and N-ethyl-N-octadecyl-1,3-diaminopropane. Examples of ether amines are N-(3-octyloxypropyl)-1,3-diaminopropane, N-(3-decyloxypropyl)-1,3-diaminopropane and N[(2,4,6-trimethyl-decyl)-3-oxypropyl]-1,3-diaminopropane.

It must be understood that it is possible to use as the polyamine compound one or more compounds in accordance with formulas (III) and/or (IV). As specific examples of mixtures of compounds complying with formula (III) reference can be made to fatty diamine fractions complying with the formula $R^3$-NH-(-$CH_2$-)$_3$-$NH_2$ whose $R^3$ groups are aliphatic $C_8$,$C_{10}$$C_{12}$,$C_{14}$,$C_{16}$,$C_{18}$,$C_{20}$ and $C_{22}$ aliphatic hydrocarbon radicals with the approximate molar proportions given in the following Table I.

TABLE I

| Alkyl chains | $C_8$ | $C_{10}$ | $C_{12}$ | $C_{14}$ | $C_{16}$ | $C_{18}$ | $C_{18-1}$* | $C_{20}$ | $C_{22}$ |
|---|---|---|---|---|---|---|---|---|---|
| Fraction | | | | | | | | | |
| A | 0% | 0% | 0% | 1% | 28% | 71% | 0% | 0% | 0% |
| B | 0% | 0% | 0% | 1% | 5% | 42% | 0% | 12% | 40% |
| C | 3% | 6% | 56% | 18% | 10% | 2% | 5% | 0% | 0% |
| D | 0% | 0% | 0% | 0% | 16% | 4.9% | 79.1% | 0% | 0% |
| E | 0% | 0% | 0% | 2.3% | 31.8% | 24.2% | 39% | 2.7% | 0% |

*$C_{18-1}$ chain having an ethylene unsaturation.

The polyamines of formulas (IV) are preferably those in which $R^3$ and $R^5$ in each case represent a hydrogen atom, D,E,F and G, which can be the same or different, each represents an alkylene group having 2 to 4 carbon atoms, e.g. ethylene, trimethylene, ethyl ethylene, tetramethylene, methyl trimethylene, 1-methyl-trimethylene and 2-methyl-trimethylene, a is an integer from 1 to 60 and b and c are equal to zero or a is an integer from 1 to 59, c is zero or an integer such that the sum a+c is 1 to 59 and b is an integer from 1 to 50, having in each case the sum a+b+c equal to an integer from 1 to 60.

As specific compounds of formula (IV) reference can be made to those complying with the formulas:

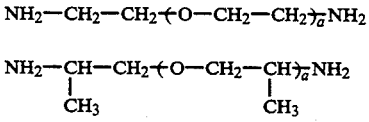

(IV$_1$)

(IV$_2$)

in which a is 2,3,5,6 or approximately 33

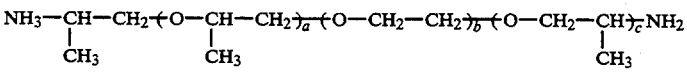

(IV$_3$)

in which b is approximately 8,9,15,16 or 40 and a+c is approximately 2 or 3.

These products are in particular marketed by TEXACO Chemical under the name Jeffamine EDR 148 for the product of formula (IV$_1$) in which a=2, Jeffamine D-230 for a product of formula (IV$_2$) of number average molecular weight 230, Jeffamine D-400 for a product of formula (IV$_2$) of number average molecular weight 400, Jeffamine D-2000 for a product of formula (IV$_2$) of number average molecular weight 2000, Jeffamine ED-600 for a product of formula (IV$_3$) of number average molecular weight 600, Jeffamine ED-900 for a product of formula (IV$_3$) of number average molecular weight 900 and Jeffamine ED-2001 for a product of formula (IV$_3$) of number average molecular weight 2000.

The products described by the Applicant in U.S. Pat. No. 4,375,974 and usable, within the scope of the present invention as constituent (B), are those resulting from the reaction of at least once polyamine, having at least one primary amino group and complying with the general formula (III), with at least one succinic derivative such as those described hereinbefore, said reaction being performed under reaction water formation and elimination conditions. Most frequently the reaction is performed at a temperature from approximately 120° C. to approximately 200° C. with an amine to succinic derivative molar ratio of approximately 0.9:1 to approximately 1.2:1. This reaction can be 10 performed in the absence of a solvent or in the presence of a solvent, such as, e.g., an aromatic hydrocarbon or a hydrocarbon fraction having a boiling point of approximately 70° C. to approximately 250° C.

The constituent (B) according to the invention can also be chosen from within the group formed by polyisobutylenes, polyisobutylene-amines and mixtures of these two compound types. The polyolefins used can be polymers or copolymers or amino or hydrogen derivatives corresponding thereto and formed from hydrocarbons having 2 to 10 carbon atoms in their molecule. These polymeric compounds are normally prepared from monoolefinic or diolefinic compounds and normally have a number average molecular weight of approximately 500 to 10,000, often approximately 500 to 3500 and preferably approximately 650 to 2600. Most frequently the starting compounds used for producing the polymers are olefins having 2 to 6 carbon atoms in their molecule, such as, e.g., ethylene, propylene, isopropylene, butene, isobutene, amylene, hexylene, butadiene and isoprene. Very frequently use is made of propylene, isopropylene, butene and isobutene. The other polyolefins which can also be used are those obtained by the cracking of olefinic polymers or copolymers having a high molecular weight of compounds with a molecular weight in the range given hereinbefore.

As non-limitative examples of specific compounds frequently used reference can be made to polypropylenes having a number average molecular weight of approximately 750 to 1000 and, e.g., approximately 800, polyisobutylenes with a number average molecular weight of 1000 to 1500 and, e.g., approximately 1300.

In another preferred embodiment according to the invention the constituent (B) is a mixture incorporating a majority proportion of polyisobutylene-ethylene-diamine and a minority proportion of polyisobutylene. This mixture is most frequently used dissolved in a hydrocarbon solvent so as to facilitate its incorporation into the fuel. The amino polymer proportion within this mixture is normally approximately 50% to approximately 80% by weight and is, e.g., approximately 60% by weight and the hydrocarbon polymer proportion is normally approximately 5 to approximately 30% by weight and preferably approximately 10 to approximately 25% by weight.

The polyisobutylene-ethylene-diamine is a compound of general formula:

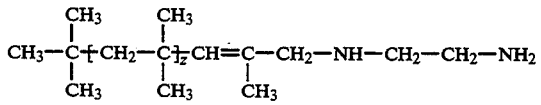

in which z is a number from approximately 10 to approximately 40, preferably approximately 30 to approximately 35 and e.g. approximately 33.

The polyisobutylene is a compound of general formula:

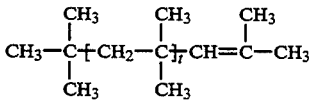

in which t is a number from approximately 10 to approximately 40, preferably approximately 30 to approximately 35 and e.g. approximately 33.

The solvent used for dissolving the polymeric compounds and for facilitating their incorporation in the fuel is usually a light aromatic distillate. It is possible to use as the constituent (B) having, dissolved in an aromatic, light distillate, a polyisobutylene and a polyisobutylene-ethylene-diamine, such as described hereinbefore, the product sold by the CHEVRON CHEMICAL COMPANY under the trade name ORONITE OGA-472. The latter is a composition incorporating approximately 60% by weight of polyisobutylene-ethylene-diamine, approximately 27% by weight polyisobutylene and approximately 13% by weight of light aromatic distillate incorporating xylene and $C_9$ alkyl benzenes.

In a preferred embodiment of the present invention, the formulations also contain at least one constituent (C) chosen from within the group formed by mineral or synthetic lubricating oils and polyglycols, soluble in said fuel, having a number average molecular weight of 480 to 2100 and of general formula (V):

$$\text{(V) HO—R—(—O—R—)}_x\text{—O—R—OH}$$

in which, each of the groups R independently represents a hydrocarbon group having 2 to 6 carbon atoms and x represents the average degree of polymerization. These polyglycols are, e.g., those described by the Applicant in European patent application EP-A-349,369.

In an advantageous embodiment the constituent (C) is a polyglycol with a polydispersity index of approximately 1 to approximately 1.25 and approximately 1 to 1.15 of general formula (V), in which each of the R groups independently represents a straight or branched alkylene group having 2 to 4 carbon atoms preferably an ethylene or propylene group.

Among the particularly preferred polyglycols of general formula (V), reference can be made to those in which each of the R groups represents a propylene group of formula:

$$CH_3—\underset{|}{CH}—CH_2—$$

The propylene used is preferably a polyglycol of number average molecular weight 600 to 1800 and most frequently 650 to 1250.

Among the mineral or synthetic lubricating oils which can be used as constituent (C), reference can, e.g., be made in non-limitative manner with respect to the mineral oils to oil 600 NS, whose main characteristics will be given hereinafter, and for synthetic lubricating oils to ethers and esters of polyols and in particular polyoxyalkylene glycol ethers.

The formulations according to the invention are in particular usable as an additive having a good anticorrosion activity for a hydrocarbon-based fuel or a mixture of hydrocarbon and at least one oxygen compound chosen from within the group formed by alcohols and ethers. These formulations are also usable as a multifunctional additive having in particular good anti-ORI properties and good detergent-dispersant properties for an engine fuel, for a controlled ignition engine, based on hydrocarbons or a mixture of hydrocarbons and at least one oxygen compound chosen from within the group formed by alcohols and ethers. Normally these formulations are added to the fuel so as to obtain a weight concentration of the additive composition in the engine fuel of 10 to 10,000 ppm and most frequently 100 to 2000 ppm.

In the formulations according to the present invention the weight ratio of constituent (A) to constituent (B) [(A)/(B)] is normally approximately 0.05:1 to approximately 2:1 and preferably approximately 0.1:1 to approximately 1:1. When the formulation also comprises a constituent (C) the weight ratio of constituent (B) to constituent (C) [(B)/(C)] is normally approximately 0.1:1 to approximately 5:1 and preferably approximately 0.2:1 to approximately 2:1.

EXAMPLE 1

Into a 2 liter reactor equipped with a mechanical stirring means, a condenser and a temperature regulating system are introduced 715 g (0.5 mole) of polypropylene glycol monoalkyl ether of number average molecular weight Mn 1430, marketed by ICI under the trade name VG 95. The reactor is heated to 186° C., accompanied by stirring for 30 minutes (min), in order to dehydrate the medium. This is followed by the slow addition of 54g (0.55 mole) of maleic anhydride and then the medium is kept at 186° C. for 18 hours. The reactor temperature is lowered to 50° C. and then 715 g of reagent VG 95 are slowly added, as well as 0.65 g of concentrated sulphuric acid. The mixture is heated to 180° C. for 10 hours. The final composition obtained is clear.

The infrared spectrum shows two absorption bands (1740 $cm^{-1}$ and 1650 $cm^{-1}$) characteristic of the ester function on the one hand and the residual unsaturation of the end product on the other. Gel chromatographic analysis (detection of the refractive index and polyethylene glycol—PEG—calibration) reveals that the product has a weight average molecular weight of approximately 4000. The acid number evaluated according to AFNOR Standard T 60112 and corrected with respect to the molecular weight (IAc) is 18000.

EXAMPLE 2

Into a 2 liter reactor equipped with a mechanical stirring system, a condenser and a temperature regulating system are introduced 629 g (0.44 mole) of polyoxyalkylene glycol monoether VG 95 and 0.57 g of concentrated sulphuric acid. The reactor is heated to 185° C., accompanied by stirring, for 30 minutes and then 23.7 g (0.24 mole) of maleic anhydride are slowly added.

The mixture is kept at 185° C. for 28 hours. This gives a composition, whereof the acid number evaluated according to AFNOR Standard T 60112 and corrected with respect to the molecular weight (IAc) is 15300.

EXAMPLE 3 (detergent composition)

1018 g of polyisobutenyl succinic anhydride (PIBSA) resulting from the condensation of polyisobutylene (polyisobutylene with a number average molecular weight of 920) on maleic anhydride (the dosing of the anhydride functions of this product shows that there is 0.7 anhydride function per theoretical mole of PIBSA) and 1018g of xylene are fed into a 2 liter reactor equipped with a mechanical stirring system, a Dean-Stark separator and a temperature regulating system.

Then, at ambient temperature and accompanied by stirring, the dropwise addition takes place of 148g (0.423 mole) of 1-(2-hydroxyethyl)-2-heptadecenyl imidazoline diluted in 148 g of xylene. The addition takes place in 30 minutes and is accompanied by a rapid increase in the temperature of the reaction mixture by approximately 5° C. The mixture is then refluxed for 3 hours with the elimination of the reaction water by azeotropic distillation. The collected water quantity is 2.3 ml (milliliter). The state of advance of the reaction can also be followed by infrared spectrometry at the adsorption band of the imine function at 1660 $cm^{-1}$ which progressively disappears during the reaction.

The reactor temperature is lowered to 50° C. and is then kept at that value throughout the progressive addition time (dropwise) of 56 g (0.297 mole) of tetraethylene pentamine diluted in 49 g of xylene. At the end of this addition, the mixture is again refluxed for 15 minutes and there is once again an elimination of water. The total water quantity collected during these two reaction stages is 7.2 ml. The infrared spectrum shows two absorption bands (1710 and 1770 cm ) characteristic of the succinimide function with a shoulder (1740 $cm^{-1}$) characteristic of the ester function. Thus, a solution is obtained with 50% by weight active material in the xylene of a composition, whose elementary analysis reveals a nitrogen content of 2.55% by weight.

EXAMPLE 4

Solutions are prepared in xylene of formulations F1 to F5 having different quantities by weight of constituents (A), (B) and (C) defined hereinafter. Constituent (A) is formed by one of the compositions obtained in Examples 1 and 2.

Constituent (B) is formed by the compostion obtained in Example 3 or by a polymeric-type composition, preferably that of polyisobutylene-ethylene-diamine and polyisobutylene, like one of those described in EP-A-327,097, U.S. Pat. No. 4,141,693, U.S. Pat. No. 4,028,065 and U.S. Pat. No. 3,966,429. In this case, the constituent (B) will be designated hereinafter by the initial PBA. This constituent is then the composition sold by CHEVRON CHEMICAL under the name ORONITE OGA 472 and containing approximately 60 parts by weight of polyisobutylene-ethylene-diamine, 13 parts by weight of polyisobutylene and 27 parts by weight of a light aromatic distillate incorporating xylene and alkyl benzenes with 9 carbon atoms in their molecule.

Constituent (C) is either a polypropylene glycol of formula:

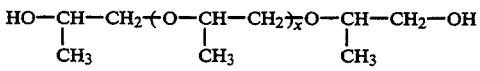

whose number average molecular weight is 922 (x=13.6) and whose polydispersity is 1.1, or a mineral or synthetic lubricating oil. Preferably, consideration is given to the basic mineral oil 600 NS, which is well known in the art and characterized by a kinematic viscosity at 40° C. between 109 and 124 centiStokes (cSt), a minimum viscosity index of 95, a maximum flow point of −9° C. and a maximum acid number of 0.05.

Formulation F1 according to the invention contains constituent (A) formed by the composition obtained in Example 1, constituent (B) formed by the composition obtained in Example 3 and constituent (C) formed by the polypropylene glycol described hereinbefore. These constituents are used in a weight ratio, in terms of the active substance, A:B:C of 1:5:5.

Formulation F2 (comparison formulation) contains constituent (B) formed by the composition obtained in Example 3 and constituent (C) formed by the polypropylene glycol described hereinbefore, but no constituent (A). The active material weight ratio B:C is 1:1.

Formulation F3 (comparison formulation) contains constituent (B) designated by the initial PBA and constituent (C) formed by mineral oil 600 NS in an active material weight ratio B:C of 1:3.

Formulation F4 according to the invention contains constituent (A) formed by the composition obtained in Example 1, constituent (B) designated by the initials PBA and constituent (C) formed by mineral oil 600 NS, in an active material weight ratio A:B:C of 1:2:6.

Formulation F5 according to the invention contains constituent (A) formed by the composition obtained in Example 2, constituent (B) formed by the composition obtained in Example 3 and constituent (C) formed by polypropylene glycol, in an active material weight ratio A:B:C of 1:5:5.

EXAMPLE 5

A series of tests is performed in such a way as to evaluate the octane requirement increase checking properties of the various additive formulations described in Example 4 in a lead-free fuel. The tests were carried out on a Renault F 3 N engine bench with a cubic capacity of 1721 $cm^3$ and a compression ratio of 9.5. This engine is equipped with a multipoint injection system, which makes it possible to measure the octane requirement of each cylinder. The test procedure is a cyclic procedure, each cycle involving the following five successive operating periods:

552 seconds (s) idling under a zero load, 5 s transient response, 2.762 s at 3500 r.p.m. (revolutions per minute) under a load of 58 Newton meter (N.m.), 276 s at 3500 r.p.m. under a load of 86 N.m., 5 s of transient response.

Each test lasts 200 hours. At the start of each test, the engine is conditioned with new valves and all deposits are removed from combustion chambers. This is followed by the determination of the octane requirements of each cylinder at the start of the test in the following way. The richness of the air-fuel mixture introduced is adjusted to the Designer's reference value for the considered measuring system (2000 r.p.m. and 3500 r.p.m.). This is followed by the successive determination of the octane requirement of each cylinder by supplying them with reference fuels constituted by mixtures of isooctane and n-heptane. The octane requirement value of a cylinder corresponds to the octane number of the reference fuel leading to the pinking phenomenon. The cyclic procedure described hereinbefore is then applied by supplying the engine with the test fuel containing or not containing an additive. At the end of the test, a new measurement of the octane requirements of each cylinder is carried out in the manner described hereinbefore. The average of the differences calculated between the octane requirement at the end of the test and the octane requirement at the start of the test for each cylinder constitutes, for the considered measuring system, the octane requirement increase value (ORI).

The following results are expressed in the form of the average ORI at the end of the test under the two considered measuring systems and the efficiency of the additives is evaluated as the difference between the average ORI at the end of the test without the additive (fuel only) and the average ORI at the end of the test with the additive. This difference is called ORD and increases as the tested additive limits the increase in the engine octane requirement. The fuel used in these evaluations is a lead-free premium grade with a motor octane number of 87 and a research octane number of 99. This premium grade has an initial boiling point of 217° C. and contains, by volume, 29% aromatics, 13% olefins and 58% saturated compounds (paraffins and naphthenes). The additives are added to the fuel so as to obtain a concentration, in active material weight in the fuel to which the additive has been added, defined for each 10 example in the following Table II, which gives the results obtained.

TABLE II

| Fuel with additive | Additive quantity | ORI at end of test 2000 r.p.m. | ORI at end of test 3500 r.p.m. | ORD compared with fuel only 2000 r.p.m. | ORD compared with fuel only 3500 r.p.m. |
|---|---|---|---|---|---|
| *Fuel only | 0 ppm | 5.6 | 4.7 | | |
| Fuel + formulation F1 | 660 ppm | 2.5 | 2.0 | 3.1 | 2.7 |
| *Fuel + formulation F2 | 600 ppm | 4.1 | 4.0 | 1.5 | 0.7 |
| | 660 ppm | 4.0 | 3.9 | 1.6 | 0.8 |
| *Fuel + formulation F3 | 800 ppm | 7.2 | 4.9 | −1.6 | −0.9 |
| Fuel + formulation F4 | 900 ppm | 5.2 | 4.5 | 0.4 | 0.2 |
| | 800 ppm | 5.0 | 4.3 | 0.6 | 0.4 |

*Comparison

EXAMPLE 6

Another series of tests is carried out so as to evaluate the octane requirement increase checking properties of additive formulations prepared in Example 4. The tests were carried out following the operating procedure described in Example 5. In these examples, the duration of the tests was fixed at 100 hours and to the fuel used was added lead alkyl with 0.15 g of lead per liter and containing, by volume, 27% aromatics, 14% olefins and 59% saturated compounds (paraffins+naphthenes). This fuel with a motor octane number of 86 and a research octane number of 99 has an initial boiling point of 34° C. and a final boiling point of 185° C. The compositions are added to the fuel so as to obtain a concentration, in weight of active material in the additive-added fuel defined for each example in the following Table III, which gives the results obtained.

TABLE III

| Fuel with additive | Additive quantity | ORI at end of test 2000 r.p.m. | ORI at end of test 3500 r.p.m. | ORD compared with fuel only 2000 r.p.m. | ORD compared with fuel only 3500 r.p.m. |
|---|---|---|---|---|---|
| *Fuel only | 0 ppm | 3.8 | 5.0 | | |
| Fuel + formulation F1 | 660 ppm | 1.6 | 3.5 | 2.2 | 1.5 |
| Fuel + formulation F5 | 660 ppm | 3.1 | 2.0 | 0.7 | 3.0 |
| *Fuel + formulation F2 | 660 ppm | 3.7 | 4.3 | 0.1 | 0.7 |

*Comparison

EXAMPLE 7

The "carburettor" detergency properties of formulations F1 and F2 prepared in Example 4 are evaluated. The engine test procedure follows European Standard R5-CEC-FO3-T-81. The results are expressed in merit or quality terms from 0 to 10. A value of 10 corresponds to a clean carburettor and a value of 0 to a highly fouled carburettor. The formulations are added to the fuel so as to obtain an active material weight concentration in the additive-added fuel defined for each example in the following Table IV, which gives the results obtained.

TABLE IV

| Additive-added fuel | Additive quantity | Merit |
|---|---|---|
| *Fuel only | 0 ppm | 4.1 |
| Fuel + formulation F1 | 660 ppm | 9.7 |
| *Fuel + formulation F2 | 660 ppm | 9.6 |

*Comparison

The fuel used in these evaluations is a lead-free premium grade of motor octane number 85.3 and research octane number 96.7. This premium grade has an initial boiling point of 36° C. and a final boiling point of 203° C. This premium grade contains, by volume 48.5% saturated compounds (paraffins and naphthenes), 9.8% olefins, 28.7% aromatics and 13% methyl tert. butyl ether.

EXAMPLE 8

Another series of tests was carried out so as to evaluate the "carburettor" detergency properties of formulations F1 and F2 prepared in Example 4. The procedure of Example 7 was followed in carrying out the tests. The fuel used in these tests is a premium grade to which has been added lead alkyls with 0.15 g of lead per liter and containing, by volume, 32% aromatics, 12% olefins and 56% saturated compounds (paraffins and naphthenes). This fuel with a motor octane number of 86 and a research octane number of 96 has an initial boiling point of 31° C. and a final boiling point of 202° C. The formulations are added to the fuel so as to obtain a concentration, in active material 10 weight in the additive-added fuel defined for each example in the following Table V, which gives the results obtained.

TABLE V

| Additive-added fuel | Additive quantity | Merit |
|---|---|---|
| *Fuel only | 0 ppm | 4.2 |
| Fuel + formulation F1 | 660 ppm | 9.7 |
| *Fuel + formulation F2 | 660 ppm | 9.7 |

*Comparison

EXAMPLE 9

The "injector" detergency properties of formulations F1 and F2 prepared in Example 4 are evaluated. The engine test procedure is in accordance with the IFP-TAE I 87 method established by the Institut Francais dn Petrole, in the manner described hereinafter. The tests are carried out on the Peugeot XU5JA test bench using a cyclic procedure and lasting in all 150 hours corresponding to the repetition of a cycle of 15 minutes operation at 3000 r.p.m. under a load of 18 kW and 45 minutes with the engine stopped.

The flow rate of each injector is measured at the start and finish of the test so as to evaluate the flow restriction percentage induced by the fouling of the injectors. The fuel used in these tests is a premium grade to which has been added lead alkyls with 0.4g of lead per liter and containing, by volume, 31.5% aromatics, 18.8% olefins and 49.7% saturated compounds (paraffins and naphthenes). This fuel of motor octane number 85.7 and research octane number 97.5 has an initial boiling point of 33° C. and a final boiling point of 197° C. The formulations are added to the fuel so as to obtain a concentration, in active material weight in the additive-added fuel defined for each example in the following Table VI, which gives the results obtained.

TABLE VI

| Additive-added fuel | Additive quantity | Injector flow restriction % at 150 hours (measurement at 6000 r.p.m.) |
|---|---|---|
| Fuel only | 0 ppm | 18.6 |
| Fuel + formulation F1 | 660 ppm | 0.2% |
| *Fuel + formulation F2 | 660 ppm | 0.3% |

*Comparison

EXAMPLE 10

A series of tests is carried out so as to evaluate the "induction valve" detergency properties of formulations F1,F2,F3 and F4 prepared in Example 4. The engine test procedure followed is that described in the literature published by the Society of Automotive Engineers (S.A.E.) under reference SAE 892121 (1989). The tests are carried out on a Honda electric ground power unit equipped with a 240 V, 5500 W generator driven by a two-cylinder 359 $cm^3$, 4-stroke engine with overhead valves Each test is performed for 80 hours with the following cyclic procedure:

1 hour operation with a generator output of 1500 W (quarter load)

1 hour operation with a generator output of 2500 W (half load).

At the start of each test, the engine is provided with new valves, Which are weighed. At the end of the test, the valves are disassembled, washed with hexane, dried and then weighed after physical elimination by scraping of the deposits formed on the valve on the combustion chamber side. The following results give the average values for the deposits in weight, based on one valve and calculated from the weight of the deposits measured on the tulip of each induction valve, based on the difference between the weight of the new valve and the weight of the valve at the end of each test after eliminating the deposits on the combustion chamber side.

The fuel used in these evaluations is a lead-free premium grade identical to that described in Example 5. The formulations are added to the fuel so as to obtain a concentration, in active material weight in the additive-added fuel defined for each example in the following Table VII, giving the results obtained:

TABLE VII

| Additive-added fuel | Quantity added | Average of deposits in mg. | Percentage reduction deposits/fuel only |
|---|---|---|---|
| *Fuel only | 0 ppm | 82 | — |
| Fuel + formulation F1 | 660 ppm | 4 | 95% |
| *Fuel + formulation F2 | 660 ppm | 5 | 94% |
| *Fuel + formulation F3 | 800 ppm | 4 | 95% |
| Fuel + formulation F4 | 800 ppm | 4 | 95% |

*Comparison

EXAMPLE 11

The anticorrosion properties of formulations F1 to F4 prepared in Example 4 are evaluated. The tests consist of determining the extent of the corrosion produced on polished ordinary steel samples in the presence of water, following the modified ASTM Standard D 665 (temperature 32.2° C., duration 20 hours). The results are given as a percentage of the surface of the corroded testpiece at the end of 20 hours. The same fuel as in Example 5 is used. The composition quantity is added to the fuel so as to obtain a concentration, in active material weight in the additive-added fuel defined for each example in the following Table VIII, which gives the results obtained.

TABLE VIII

| Additive-added fuel | Additive quantity | % corroded surface |
|---|---|---|
| *Fuel only | 0 ppm | 100 |
| Fuel + formulation F1 | 660 ppm | 0 |
| *Fuel + formulation F2 | 660 ppm | 0 |
| *Fuel + formulation F3 | 800 ppm | 5 |
| Fuel + formulation F4 | 800 ppm | 0 |

*Comparison

EXAMPLE 12

Tests were carried out so as to evaluate the anticorrosion properties of the formulations according to the invention prepared in Example 4. The tests are carried out in a similar way to that described in Example 11 (temperature 60° C., duration 20 hours) in a diesel fuel having the following characteristics:

| | |
|---|---|
| Filtrability limit temperature | −3° C. |
| Initial boiling point | 162° C. |
| 95% boiling point | 366° C. |
| Density at 15° C. | 0.8331 |
| Calculated cetane number | 50.4 |

The composition quantity is added to the fuel so as to obtain a concentration, in active material weight in the additive-added fuel defined for each example in Table IX, which summarizes the results obtained:

TABLE IX

| Additive-added fuel | Additive quantity | % corroded surface |
|---|---|---|
| *Fuel only | 0 ppm | 100 |
| Fuel + formulation F1 | 660 ppm | 0 |
| *Fuel + formulation F4 | 900 ppm | 0 |

*Comparison

The analysis of the results obtained in the preceding examples shows that the formulations according to the invention make it possible to very significantly limit the octane requirement increase of controlled ignition engines and shows the detergency and anticorrosion qualities of the additives with respect to the admission system. These compositions used in a diesel fuel also have anticorrosion properties.

We claim:

1. A fuel additive composition comprising:

at least one component (A) and at least one component (B), wherein said component (A) consists essentially of at least one product resulting from the reaction of at least one dicarboxylic compound (D) with at least one polyoxyalkylene glycol monoether (E) of the following formula:

$$R^1\text{-O-}(R^2\text{-O})_n\text{-H}$$

wherein $R^1$ is a hydrocarbon group having 1 to 30 carbon atoms, $R^2$ is a divalent hydrocarbon group having 2 to 6 carbon atoms, and n is a number from 1 to 60, wherein said at least one dicarboxylic compound (D) is maleic anhydride, and said at least one polyoxyalkylene glycol monoether (E) is a compound of formula (I) having a molecular weight of 500–2,500, in which $R^1$ is an alkyl, aryl, arylalkyl or alkylaryl group, and $R^2$ is an alkylene group of the following formula:

$$—CH_2—CR^3H— \quad \text{(II)},$$

in which $R^3$ is hydrogen, methyl, ethyl, or propyl, and wherein said reaction is performed at a temperature of 100° C.–210° C. and a molar ratio of compound (E) to compound (D) of 1.5:1–5:1 for a time sufficient to ensure that the resultant reaction products have a corrected acid number of 3,000–30,000; and the component (B) consists essentially of at least one detergent-dispersant product selected from the group consisting of:

(1) mixtures of polyisobutylenes and polyisobutyleneamines, (2) products resulting from the reaction of at least one succinic derivative with at least one 1-(2-hydroxyethyl)-imidazoline substituted in the 2-position by a straight or branched alkyl or alkenyl radical having 1 to 25 carbon atoms, wherein said succinic derivative is selected from the group consisting of alkenyl succinic acids, anhydrides of alkenyl succinic acids, polyalkenyl succinic acids, and anhydrides of polyalkenyl succinic acids having a number average molecular weight of 200 to 3,000, the imidazoline/succinic derivative molar ratio being 0.1:1 to 0.9:1, and wherein said reaction is performed under conditions whereby formation and elimination of at least 0.15 mole of water per mole of imidazoline used occurs and further reacting with at least one polyamine of the following formulae:

$$R^3-Z-[(CH)_p(R^4)NH]_m-H \quad \text{(III)}$$

$$R^3-N(R^5)-D-(O-E)_a-(O-F)_b-(O-G)_c-NH_2, \quad \text{(IV)}$$

in which $R^3$ is a hydrogen atom or a hydrocarbon group having 1 to 60 carbon atoms, Z is —O— or —$NR^5$—, $R^5$ is a hydrogen atom or a hydrocarbon group having 1 to 60 carbon atoms, $R^3$ and $R^5$ can also, together with the nitrogen atom to which they are bonded, form a heterocycle, $R^4$, in each case independently, is a hydrogen atom or a hydrocarbon group having 1 to 4 carbon atoms, p is an integer from 2 to 6, m is an integer from 1 to 10 when Z is —$NR^5$— and an integer from 2 to 10 when Z is —O—, D, E, F and G, which can be the same or different, are each a divalent hydrocarbon group having 2 to 6 carbon atoms, a is an integer from 1 to 60, b and c, which can be the same or different, are each zero or an integer from 1 to 50 and the sum a+b+c is an integer from 1 to 60, wherein the polyamine quantity reacted is at least 0.1 mole per mole of succinic derivative introduced; and (3) products resulting from the reaction, under reaction water formation and elimination conditions, of at least one succinic derivative selected from the group consisting of alkenyl succinic acids, alkenyl succinic acid anhydrides, polyalkenyl succinic acids, and polyalkenyl succinic acid anhydrides with at least one amine of formula (III); and said composition further comprising at least one component (C) selected from the group consisting of mineral or synthetic lubricating oils and polyglycols, soluble in hydrocarbon fuel, having a number average molecular weight 480 to 2100, and said polyglycols are of the following formula:

$$HO-R-(-O-R-)_x-O-R-OH \quad \text{(V)}$$

in which each of the R groups independently is a hydrocarbon group having 2 to 6 carbon atoms and x represents the average degree of polymerization.

2. A composition according to claim 21, wherein component (B) is a reaction product from (a) the reaction, in a first stage, of at least one succinic derivative selected from the group consisting of alkenyl succinic and polyalkenyl succinic anhydrides having a number average molecular weight of 200 to 3000 with 1-(2-hydroxyethyl)-2-heptadecenyl imidazoline or 1-(2-hydroxyethyl)-2-methyl imidazoline and (b) in a second stage, the reaction of the product resulting from said first stage with at least one polyamine of the following formula:

$$R^3-Z-[(CH)_p(R^4)NH]_m-H, \quad \text{(III)}$$

in which $R^3$ and $R^4$ in each case is a hydrogen atom,

Z is —$NR^5$—, $R^5$ is a hydrogen atom, p is 2, and m is an integer from 1 to 5.

3. A composition according to claim 1, wherein component (B) is a reaction product from (a) the reaction in a first stage of at least one succinic derivative selected from the group consisting of alkenyl succinic and polyalkenyl succinic anhydrides of number average molecular weight 200 to 3000 with 1-(2-hydroxyethyl)-2-heptadecenyl imidazoline or 1-(2-hydroxyethyl)-2-methyl imidazoline and (b) in a second stage, the reaction of the product from said first stage with at least one polyamine of the following formula:

$$R^3-N(R^5)-D-(O-E)_a-(O-F)_b-(O-G)_c-NH_2, \quad \text{(IV)}$$

in which $R^3$ and $R^5$ in each case is a hydrogen atom,

D, E, F and G, which can be the same or different, are in each case a divalent hydrocarbon group having 2 to 4 carbon atoms, a is an integer from 1 to 60 and b and c are equal to zero, or a is an integer from 1 to 59, c is zero or an integer such that the sum a+c is 1 to 59 and b is an integer from 1 to 50, wherein the sum a+b+c in all cases is an integer from 1 to 60.

4. A composition according to claim 1, wherein component (B) is selected from the group consisting of said products resulting from the reaction of at least one succinic derivative selected from the group consisting of alkenyl succinic and polyalkenyl succinic anhydrides of number average molecular weight 200 to 3000 with at least one 1-(2-hydroxyethyl)-imidazoline substituted in the 2-position by a straight or branched alkyl or alkenyl radical having 1 to 25 carbon atoms, the imidazoline/succinic derivative molar ratio being 0.1:1 to 0.9:1, and wherein said reaction is performed under conditions whereby formation and elimination of at least 0.15 mole of water per mole of imidazoline used occurs, and further reacting with at least one amine of the following formula:

$$R^3-Z\left[\left(\overset{R^4}{\overset{|}{C}}H\right)_p NH\right]_m H, \quad \text{(III)}$$

wherein $R^3$ and $R^4$ in each case is a hydrogen atom,

Z is $-NR^5-$, $R^5$ is a hydrogen atom,

P is 2, and m is an integer from 1 to 5, and wherein said further reacting is performed at a temperature of 65°–250° C. and the total quantity of substituted imidazoline and polyamine is 0.8–1.2 moles per mole of succinic derivative.

5. A composition according to claim 1, wherein component (B) is a mixture of polyisobutylene and polyisobutylene-amine.

6. A composition according to claim 5, wherein component (B) is a mixture containing a minority proportion of polyisobutylenes and a majority proportion of polyisobutylene-ethylenediamines.

7. A composition according to claim 1, wherein component (C) is a polyglycol having a polydispersity index of 1 to 1.25 and of formula (V), in which each of the R groups independently is a straight or branched alkylene group having 2 to 4 carbon atoms.

8. A composition according to claim 7 wherein each of the groups R is independently ethylene or propylene.

9. A composition according to claim 1, wherein components (A) and (B) are present in an (A)/(B) weight ratio of 0.05:1 to 2:1.

10. A composition according to claim 1, wherein the (B)/(C) weight ratio is 0.1:1 to 5:1.

11. A composition according to claim 1, wherein (B) is selected from the products (2).

12. A composition according to claim 1, wherein the reaction products obtained by reaction of compound (E) and compound (D) have a corrected acid number of 4000–25,000.

13. A composition according to claim 1, wherein:

component (A) consists essentially of at least one product resulting from the reaction of maleic anhydride and at least one polyoxyalkylene glycol monoalkyl ether of formula I having a molecular weight of 500–2,500, wherein $R^1$ is alkyl of 1–25 C atoms, $R^2$ is a divalent hydrocarbon group of 2–6 C atoms, and n is a number from 1 to 60, component (B) a reaction product from (a) the reaction, in a first stage, of at least one succinic derivative selected from the group consisting of alkenyl succinic and polyalkenyl succinic anhydrides having a number average molecular weight of 200 to 3000 with 1-(2-hydroxyethyl)-2-heptadecenyl imidazoline or 1-(2-hydroxyethyl)-2-methyl imidazoline and (b) in a second stage, the reaction of the product resulting from said first stage with at least one polyamine of the following formula:

$$R^3-Z\left[\left(\overset{R^4}{\overset{|}{C}}H\right)_p NH\right]_m H, \quad \text{(III)}$$

in which $R^3$ and $R^4$ in each case is a hydrogen atom,

Z is $-NR^5-$, $R^5$ is a hydrogen atom, p is 2, and m is an integer from 1 to 5.

14. A composition according to claim 13, wherein said at least one reaction product from the reaction of maleic anhydride and said polyoxyalkylene glycol monoalkyl ether has a corrected acid number of 4000–25,000.

15. A fuel composition comprising: a minor amount of an additive composition according to claim 1, and a hydrocarbon fuel.

16. A fuel composition according to claim 15, wherein said hydrocarbon fuel is gasoline.

17. A fuel composition according to claim 15, wherein said fuel composition contains 10 to 1,000 ppm by weight of said additive composition.

18. A fuel composition according to claim 17, wherein said additive composition contains components (A) and (B) in a (A)/(B) weight ratio of 0.05:1 to 2:1.

19. A fuel composition according to claim 18, wherein said additive composition contains component (C) and component (B) in a (B)/(C) weight ratio of 0.1:1 to 5:1.

20. A composition according to claim 19 wherein said component (C) is said polyglycol.

* * * * *